United States Patent [19]

Schmitz et al.

[11] 4,166,308

[45] Sep. 4, 1979

[54] FOLD OR PLEAT FIXING ARRANGEMENT FOR CURTAINS OR DRAPES

[75] Inventors: Rudolf Schmitz, Kastanienbaum, Switzerland; Hermann Pape, Laggenbeck, Fed. Rep. of Germany; Hans Stoecker, Wil, Switzerland

[73] Assignee: Gardisette Holding AG, Switzerland

[21] Appl. No.: 843,042

[22] Filed: Oct. 17, 1977

[30] Foreign Application Priority Data

Jul. 16, 1977 [DE] Fed. Rep. of Germany ..... 2732242

[51] Int. Cl.[2] ..... A44G 21/00; A47H 13/14

[52] U.S. Cl. ..... 24/84 R; 24/81 DS; 24/73 CH; 24/81 R; 160/348

[58] Field of Search ..... 160/123, 124, 125, 126, 160/330, 345, 346, 347, 348; 16/87 R, 87 B, 87.2, 87.4, 87.6 R, 87.6 W, 87.8; 24/73 CH, 81 DS, 84 R

[56] References Cited

U.S. PATENT DOCUMENTS

| | | | |
|---|---|---|---|
| 2,552,922 | 5/1951 | Andreou | 24/73 CH |
| 2,765,844 | 10/1956 | Kuddes | 160/348 |
| 3,399,712 | 9/1968 | Weisberg | 160/348 |
| 3,735,795 | 5/1973 | Broek | 160/348 |
| 3,861,001 | 1/1975 | Pape | 24/81 DS |
| 3,901,303 | 8/1975 | Falkenberg | 24/73 CH |
| 3,921,696 | 11/1975 | Pape | 160/330 |

FOREIGN PATENT DOCUMENTS

| | | | |
|---|---|---|---|
| 2307160 | 9/1974 | Fed. Rep. of Germany | 160/348 |
| 2550786 | 5/1977 | Fed. Rep. of Germany | 24/73 CH |

*Primary Examiner*—Bernard A. Gelak
*Attorney, Agent, or Firm*—Craig and Antonelli

[57] ABSTRACT

An arrangement for fixing folds or pleats of curtains or drapes which includes a retaining plate member and a fold clasp member which can be elastically locked together with the retaining plate member. The fold clasp member has arranged on a front side thereof at least two mutually aligned fold clamping devices defined by webs which are spaced from one another so as to define a fold or pleat receiving slot. One of the clamping devices projects at a further distance from the front surface of the fold clasp member than the other of the clamping devices. Centrally arranged locking devices are provided on the retaining plate member with elastically deformable wings being provided on both sides of the locking devices, which wings extend with outer longitudinal sides into the proximity of the retaining plate member. Cooperating rows of tooth-like projections are provided along longitudinal edges of both the retaining plate member and the fold clasp member with the tooth-like projections of the fold clasp member being disposed between adjacent tooth-like projections when the retaining plate member and the fold clasp member are brought into a locking position.

16 Claims, 13 Drawing Figures

FIG.1
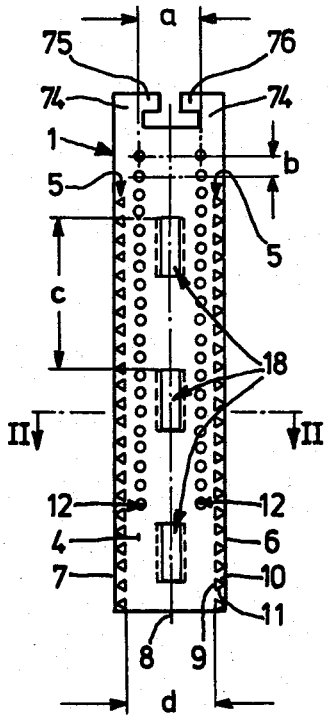
FIG. 2
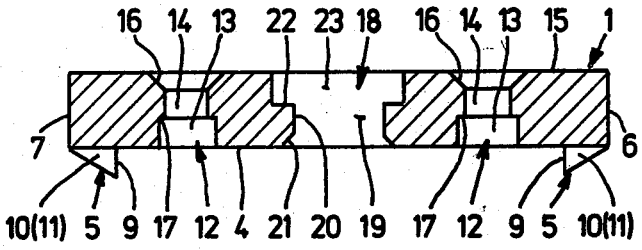
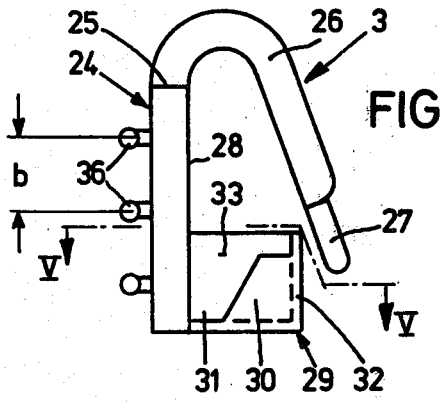
FIG.3
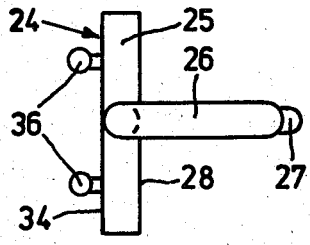
FIG.4
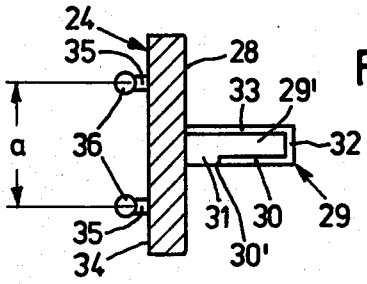
FIG.5

FIG. 6
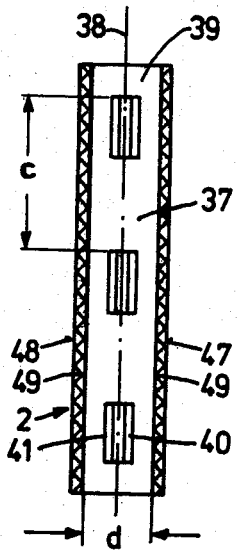
FIG. 7
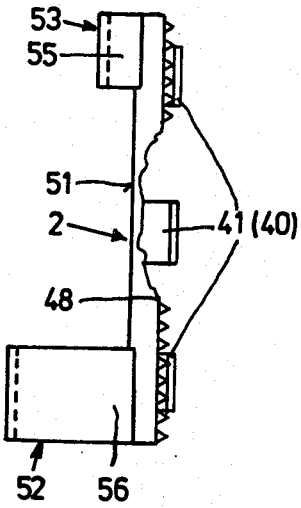
FIG. 9
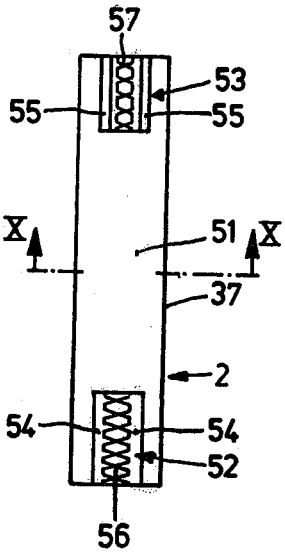
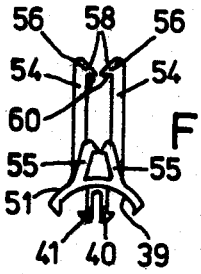
FIG. 8
FIG. 10
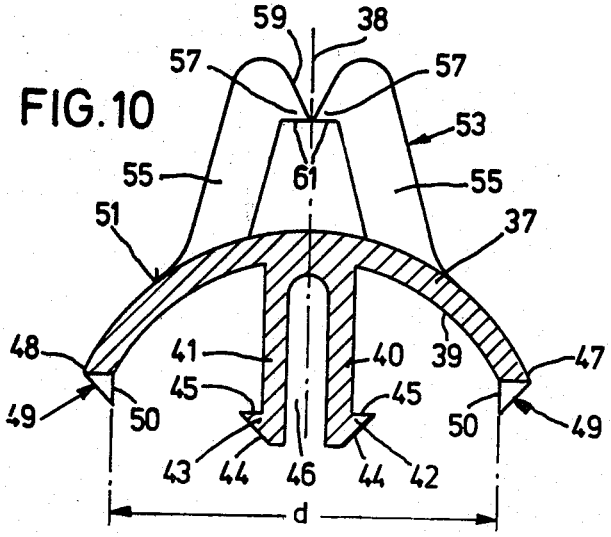

FOLD OR PLEAT FIXING ARRANGEMENT FOR CURTAINS OR DRAPES

The present invention relates to an arrangement for fixing folds or pleats in curtains and drapes which includes vertically extending webs open at the top and bottom ends thereof with at least one fold or pleat of the drapery material being introduced into at least one slot of the fold fixing arrangement and being held therein under an elastic clamping action. The slot is formed between two webs with barb-like projections being arranged at the two webs, which projections extend in a direction of a respective fold or pleat receiving slot.

Drape or curtain fold fixing devices have been proposed, for example, in German Pat. No. 2,227,199 and U.S. Pat. No. 3,861,001, which devices are formed as integral elements, thereby having the general advantage of being of a relatively simple structure. However, a shortcoming of the proposed devices resides in the fact that the folds or pleats are held only at their bases.

In U.S. Pat. No. 3,223,148, another device for fixing folds or pleats in curtains or drapes is proposed wherein the folds or pleats are retained in a one-piece retaining element which is constructed of a hard elastic synthetic resin with spaced webs extending from a top and bottom of the retaining element being provided and defining therebetween fold receiving slots. The inserted fold or pleat is held under an elastic clamping action in the respective slots with the slots having an inner circularly enlarged closed portion at an inner side thereof so that the folds or pleats can be retained at bases thereof by means of a holding bar having a circular cross-section.

In the last-mentioned proposed fixing device, the webs, fashioned as hollow elements, must have a sufficient elasticity so that the circular holding bars can be introduced together with the doubled-up layer of fabric from the front through the slots. However, this elasticity is disadvantageous in that the holding bar can also be pulled out of the slot with the same amount of force by which the curtain fabric with the holding bar is pressed into the slot. A further disadvantage resides in the fact that the relatively large width of the slot at its inner end requires a correspondingly large spacing between individual adjacent slots so that the total retaining element becomes relatively large and bulky. This latter disadvantage, in turn, results in a retaining element which cannot be utilized to achieve a closely gathered fold arrangement. Additionally, due to the fact that the fixation of the folds is not very secure, there is a danger that the retaining element will detach itself from the fabric during the washing or drycleaning of the curtain or drape.

In U.S. Pat. No. 1,149,628, a device for fixing folds or pleats of curtains is proposed wherein downwardly projecting claws are provided on a holding ring which is adjustable in the diameter and is guided along a cylindrical curtain rod. A single claw is arranged on a side facing the back of the curtain with the single claw having forwardly projecting barbs. Two parallel extending, finger-like claws with rearwardly projecting barbs are arranged on the side facing the front of the curtain with the curtain fabric being held at various points by means of the claws.

One shortcoming of the last-mentioned proposed device resides in the fact that, due to the two forward finger-like claws, a fold extending toward the front at right angles to the curtain can be readily withdrawn or pulled out. Furthermore, this conventional fixing device is merely capable of holding a simple T-fold. Another disadvantage of this conventional fixing device resides in the fact that a formation of a so-called "head" at the curtain, that is, the formation of a part at the curtain projecting upwardly beyond the holding fixture, is impossible. Also, this conventional arrangement is unsuitable for holding more sensitive drapery fabrics since the fabric is apt to tear when a load is exerted due to the point-like mounting at the barbs of the claws. Furthermore, the forwardly disposed finger-like claws are visible when forming a forwardly projecting fold, thereby resulting in an esthetically unattractive arrangement.

Another holding device for curtains or drapes is proposed in German Pat. No. 2,255,328 and U.S. Pat. No. 3,921,696, wherein a hook is attached to a holding means with the aid of lugs having spherical heads, which lugs project from a plate of the hook with the spherical heads of the lugs being introduced into corresponding openings of the holding means.

The aim underlying the present invention essentially resides in providing a drapery or curtain fold or pleat fixing device by means of which forwardly projecting folds or pleats are securely and accurately fixed in their shape without the folds or pleats becoming entirely inherently rigid in a zone of fixation.

According to advantageous features of the present invention, an elastic fold clasp which can be locked together with a retaining plate is provided with the elastic fold clasp having arranged on a front side thereof at least two, mutually aligned, spaced-apart, fold clamping means formed by webs with at least one of the fold clamping means projecting approximately over a distance corresponding to a depth of the folds or pleats to be fixed, whereas the other fold clamping means projects by a markedly smaller distance. The fold clasp can be locked to the retaining plate at a spacing therefrom by means of centrally disposed locking elements with elastically deformable wings extending with their outer longitudinal sides into the proximity of the retaining plate on both sides of the locking elements. Moreover, the fold clasp carries or has arranged thereon in a zone of longitudinal sides thereof, toothlike projections with the retaining plate carrying or having arranged thereon further tooth-like projections with both toothlike projections being operatively associated with one another when the fold clasp is locked in the retaining plate.

By virtue of the above-noted advantageous features of the present invention, it is possible to hold folds or pleats to be fixed in an extensively projecting fold clamping means extending only over a small zone of the total height of the fold or pleat forming device so that the folds or pleats are fixed in a position over their entire depth.

Additionally, in accordance with another feature of the present invention, only the base of one or several folds is held in the other fold clamping means so that the folds can spring apart without changing their position relative to the pleat or fold fixing device.

Moreover, according to the present invention, at the transition from an unfolded zone of the curtain or drape to the folds or pleats, a double layer of fabric is fixed firmly between the fold clasp and the retaining plate, whereby also the outer layer of fabric of the externally lying folds is accurately fixed in position at the same time. At this position, the curtain or drapery proper is borne by the fold or pleat fixing arrangement. The thicker and/or the heavier the curtain or drapery fabric, the wider the elastically formable wings of the fold clasp extend with an elastic action so that the clamping force between the fold clasp and the retaining plate is proportionately stronger. Due to the construction provided by the present invention, the entire fold or pleat fixing device lies on the back of the curtain and is not visible from the front side thereof.

Advantageously, according to a further feature of the present invention, the fold clasp has a cross-section of approximately the shape of a cylindrical segment and at least one pair of elastic webs with outwardly projecting lugs having abutment surfaces are provided on the inside of the fold clasp, which elastic webs cooperate with contact surfaces of associated locking apertures arranged on the retaining plate.

Furthermore, according to the present invention, a hook having at least one row with at least two projecting pins which can be introduced into corresponding openings in the retaining plate is arranged on the fold or pleat fixing device whereby the present invention is adaptable to the so-called American suspension system. To ensure an absolutely secure but detachable hanging action, the hook is provided with a bracket mounted to a plate with a free end of the bracket being connectable to the retaining plate in the manner of a safety pin.

Accordingly, it is an object of the present invention to provide a drapery or curtain fold or pleat fixing arrangement which avoids, by simple means, the shortcomings and drawbacks encountered in the prior art.

Another object of the present invention resides in providing a drapery or curtain fold or pleat fixing arrangement which is simple in construction and therefor inexpensive to manufacture.

A further object of the present invention resides in providing a drapery or curtain fold or pleat fixing arrangement which ensures an absolute securing or fixing of the folds or pleats when the curtain or drapes are hanging, removed from a curtain or drapery rod, washed or cleaned, and/or transported.

Yet another object of the present invention resides in providing a drapery or curtain fold or pleat fixing arrangement wherein the thicker and/or heavier the curtains or drapes, the greater the clamping force exerted between the clamping elements.

A still further object of the present invention resides in providing a drapery or curtain fold or pleat fixing arrangement which is readily attachable to the top of curtains or drapery material and which accurately fixes the folds or pleats in place.

Still another object of the present invention resides in providing a drapery or curtain fold or pleat fixing arrangement which is readily adaptable to the so-called American suspension system.

These and other objects, features and advantages of the present invention will become more apparent from the following description when taken in connection with the accompanying drawings which show, for the purposes of illustration only, one embodiment in accordance with the present invention, and wherein:

FIG. 1 is a plan view of a retaining plate of a fold or pleat fixing device in accordance with the present invention;

FIG. 2 is an enlarged cross-sectional view taken along the line II—II in FIG. 1;

FIG. 3 is a side view of a hook of a fold fixing device in accordance with the present invention;

FIG. 4 is a plan view of the hook of FIG. 3;

FIG. 5 is a cross-sectional view of the hook taken along the line V—V in FIG. 3;

FIG. 6 is a back view of a fold clasp of a fold or pleat fixing device in accordance with the present invention;

FIG. 7 is a lateral view of the fold clasp of FIG. 6;

FIG. 8 is a bottom view of the fold clasp of FIG. 6;

FIG. 9 is a top view of the fold clasp of FIG. 6;

FIG. 10 is a partial cross-sectional view, on an enlarged scale, of a detail of the fold clasp of FIGS. 6–9;

Figure 11:
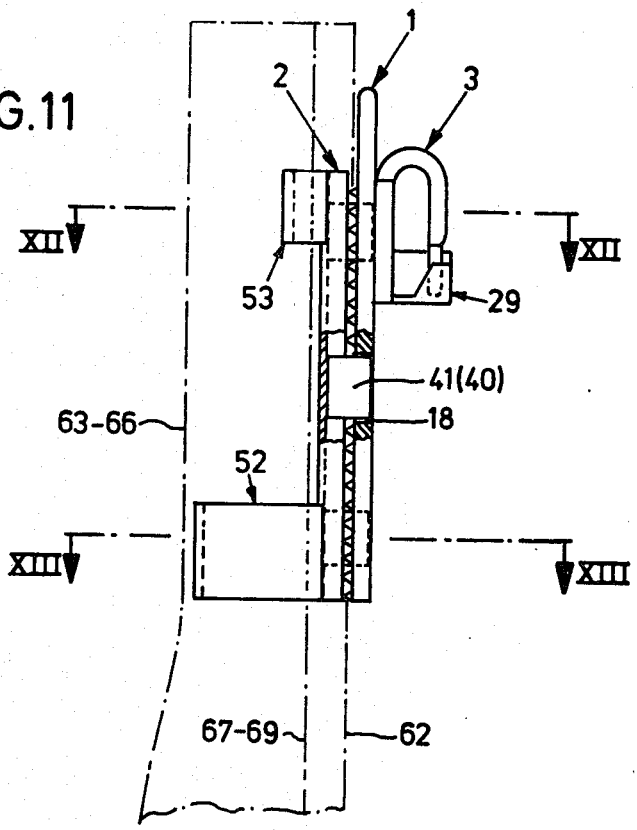
FIG. 11 is a lateral view of an assembled fold or pleat fixing device in accordance with the present invention with the folds or pleats of a curtain or drape inserted therein.
Figure 12:
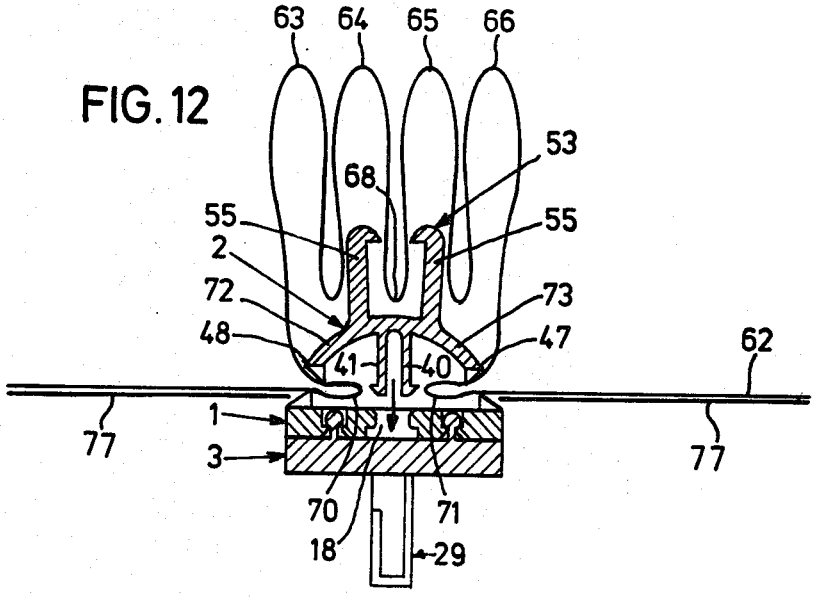
FIG. 12 is a cross-sectional view taken along the line XII—XII in FIG. 11.

Referring now to the drawings wherein like reference numerals are used throughout the various views to designate like parts and, more particularly, to FIGS. 11 and 12, a curtain or drape fold or pleat fixing arrangement is provided which includes a retaining plate generally designated by the reference numeral 1 having a fold clasp generally designated by the reference numeral 2 detachably mounted on a front side thereof and a hook generally designated by the reference numeral 3 detachably mounted to a backside of the retaining plate 1.

As shown most clearly in FIGS. 1 and 2, the retaining plate 1 has a flat, oblong, rectangular shape and is provided, on its front side or surface 4, with at least two rows of tooth-like projections generally designated by the reference numeral 5 with the respective rows being arranged in proximity to an associated lateral edge 6, 7. The rows of tooth-like projections 5 extend parallel to each other and to a line of symmetry 8 of the retaining plate 1. Each of the tooth-like projections are shaped as a triangular pyramid having one lateral face 9 disposed away from an associated lateral edge 6 or 7 and extending vertically upwardly from a front side or surface 4 of the retaining plate 1 with two other lateral faces 10, 11 extending at a shallow or slight inclination toward an associated outer edge.

One row of apertures 12 is arranged on both sides of and parallel to the line of symmetry 8. The rows of apertures 12 are disposed at an equal spacing or distance from the line of symmetry 8 and extend between and parallel to the rows of tooth-like projections 5. The apertures or openings 12 each include a cylindrical section 13 located toward the front side or surface 4 of the retaining plate 1, a subsequent cylindrical section 14 of a smaller diameter than the cylindrical section 13 disposed within the interior of the retaining plate 1, and a truncated cone section 16 flaring toward a backside or surface 15 of the retaining plate 1.

An annular contact shoulder 17, oriented toward the front side or surface 4 of the retaining plate 1, is formed at the transition between the cylindrical section 13 and the smaller diameter cylindrical section 14.

Three locking openings generally designated by the reference numeral 18 are provided along the line of symmetry 8 with each locking opening 18, as viewed from above, having an approximately rectangular cross-section and extending through the retaining plate 1 from the front side or surface 4 to the backside or surface 15. The locking openings 18 include a rectangular section 19 arranged in the interior of the retaining plate 1 with the rectangular section including spaced vertically extending lateral surfaces 20 which are adjoined by spaced surfaces 21 which flare toward the front side or surface 4. Toward the backside or surface 15 of the retaining plate 1, the lateral surfaces 20 of the rectangular section 19 are adjoined by contact surfaces 22 so as to define a widened section 23 which opens toward the backside or surface 15.

As shown most clearly in FIGS. 3–5, the hook 3 includes a plate generally designated by the reference numeral 24 having an elastically deformable bracket 26 attached to a top side 25 of the plate 24 with the bracket 26 being bent toward the rear or backside or surface 28 of the plate 24 in a downward direction. The bracket 26 is provided with a tapered section 27 in a zone of its free end thereof. An upwardly open box generally designated by the reference numeral 29 is arranged in a lower zone of the backside or surface 28 of the plate 24 with the box 29 facing the bracket 26 and being attached to the plate 24. One side wall 30 of the box 29 is provided with a recess 31 in a zone of the backside or surface 28 of the plate 24.

By bending the bracket 26 toward the backside or surface 28 of the plate 24, with a simultaneous slight lateral deformation, the tapered section 27 of the bracket 26 is guided beyond an edge 30' of the side wall so that the tapered section 27 can be inserted through a recess into an interior 29' of the box 29. When a load on the bracket 26 is relieved, the tapered section 27 contacts a rear wall 32 of the box 29 and is fixed laterally between the side wall 30 and an opposite wall 33 by virtue of the elastic expansion of the bracket 26. Thus, the hook 3 can be closed in the manner of a conventional safety pin.

Two rows of vertically projecting pegs are arranged on a front side or surface 34 of the plate 24 with each peg 35 terminating in an elastically deformable spherical head 36. The two rows of pegs 35 with heads 36 are spaced from each other at a distance a, which distance corresponds to the spacing or distance between the two rows of apertures 12 in the retaining plate 1. Two adjacent pegs 35 with heads 36 in respective rows are spaced at a distance b which corresponds to the spacing or distance between two adjacent apertures or openings 12 in the retaining plate 1.

The diameter of the pegs 35 is slightly smaller than the diameter of the narrow cylindrical sections 14 in the retaining plate 1, whereas the diameter of the spherical heads 36 is somewhat larger than the diameter of the narrow cylindrical sections 14 in the retaining plate 1 and is somewhat smaller than the diameter of the wide cylindrical sections 13 in the retaining plate 1.

To connect the hook 3 and retaining plate 1 to each other, the heads 36 are pressed into the truncated cone-shaped sections 16 whereby the heads 36 are subjected to a slight elastic deformation so that they can be forced through the narrower sections 14 of the retaining plate 1. Upon being pressed through the narrow sections 14, the heads 36 expand elastically in the wide cylindrical section 13 so as to engage behind the contact shoulders 17, thereby establishing a very firm connection between the hook 3 and the retaining plate 1, which connection can be disengaged when expending a maximum amount of force. By virtue of the provision of a relatively large number of apertures or openings 12 in each row of the retaining plate 1, the hook 3 can be attached at various different vertical levels of the retaining plate 1.

As shown most clearly in FIGS. 6–10, the fold clasp 2 includes an elastically deformable clasp section 37 of an oblong shape which is approximately rectangular in cross-section in a top view. As seen in cross-section (FIG. 10), the clamping element 37 has approximately a configuration of an annular cylindrical segment and is constructed symmetrically to a plane of symmetry 38. Elastic webs 40, 41 are provided on an inside surface or side 39 of the curved clasp section 37 with the webs respectively projecting in pairs and being provided with outwardly projecting barbs 42, 43 arranged in a free end zone of the webs 40, 41.

The barbs 42, 43 each comprise inclined faces 44 extending away from the inside surface or side 39 toward each other and abutment surfaces 45 facing the inner surface or side 39. Three pairs of webs 40, 41 are arranged at the same mutual spacing c as the locking openings 18 in the retaining plate 1 with the length of webs 40, 41 being somewhat smaller than the length of the locking openings 18.

To lock the fold clasp 2 to the retaining plate 1, the clasp 2 and plate 1 are pressed against each other so that the inclined surfaces contact the introduction surfaces of the retaining plate 1. If a mutually opposed force is exerted, the webs 40, 41 are thereby moved elastically toward one another, that is, toward the plane of symmetry 38 by virtue of the free space 46 provided between the webs 40, 41. After the barbs 42, 43 have been pushed through the narrowest section 19 in the retaining plate 1, the webs 40, 41 again elastically spring back into their open positions so that abutment surfaces 45 of the barbs 42, 43 engage the contact surfaces 22 of the retaining plate 1, whereby the fold clasp 2 and the retaining plate 1 are firmly locked together.

A release of the locking action between the retaining plate 1 and fold clasp 2 is only possible by bending the webs 40, 41 together again so that the barbs 42, 43 can be pulled out through the narrow section 19 of the retaining plate 1.

One row of tooth-like projections 49, fashioned or constructed identically to the tooth-like projections 5, is disposed along the respective longitudinal sides 47, 48 of the clasp section 37. A spacing d is provided between the two rows of projections 49, which spacing is the same as the spacing provided between the rows of tooth-like projections 5 of the retaining plate 1. The individual projections 49 are arranged so as to pass between two adjacent tooth-like projections 5 of the retaining plate 1 during a locking of the fold clasp 2 to the retaining plate 1. Thus, each of the projections 49 comprise lateral faces 50 facing each other and located in parallel to the plane of symmetry 38.

The length of the webs 40, 41, on the one hand, and the curvature of the clasp section 37, on the other hand, is selected so that when the fold clasp 2 is locked together with the retaining plate 1, there is still a space between the respective tips of the projections 5 or 49 and the associated front side or surface 4 of the retaining plate 1 or the longitudinal edges 47, 48 of the fold clasp 2.

Two fold clamping means generally designated by the reference numerals 52, 53 are arranged at a spacing from each other on the front surface or side 51 of the clasp section 37. The clamping means 52, 53 respectively include two pairs of webs 54, 55 arranged at a spacing from each other with the webs 54, 55 being provided at the free end zones thereof with tooth-like projections 56, 57, respectively, which are oriented toward each other. The tooth-like projections 56, 57 are provided on outside surfaces thereof with insert faces 58, 59 which are inclined toward a front surface or side 51 of the clasp section 37. The projections 56, 57 on a side located toward the front surface or side 51 of the clasp section 37 is provided with lateral faces 60, 61, respectively, which extend approximately vertically to the plane of symmetry 38. Thus, the tooth-like projections 56, 57 are likewise fashioned as barbs. The webs 54 of the fold clamping means 52 project outwardly to a greater extent from the front side or surface 51 than the webs 55 of the fold clamping means 53.

Figure 13:
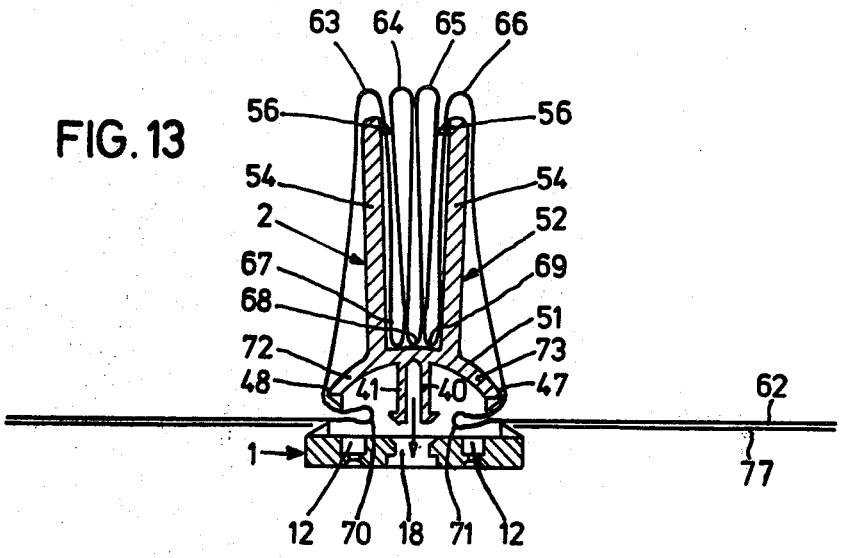
FIG. 13 is a cross-sectional view taken along the line XIII—XIII in FIG. 11.

To form and fix in position four forwardly projecting folds or pleats 63, 64, 65, 66 at the top edge of a curtain or drapery 62, the folds or pleats are formed while gathering the fabric of the curtain or drapery 62 appropriately and, as shown most clearly in FIG. 13, the three fold bases 67, 68, 69, located between the two middle folds 64, 65 and at the transition to the two outer folds 63, 66 are pushed between the webs 54 of the fold clamping means 52 while correspondingly expanding the clamping means 52 so as to reach a portion of the front surface or sides 51 of the fold clasp 2 located between the webs 54.

After relieving a load on the webs 54, the webs 54 return into elastic mutual contact and retain the fabric of the curtain or drapery firmly by means of the tooth-like projections 56 so that the fabric of the curtain or drapery 62 can no longer be withdrawn or pulled out without bending apart the webs 54.

Simultaneously therewith or subsequent thereto, as shown in FIG. 12, the middle fold or pleat base 68 of the folds or pleats is pushed between the webs 55 of the smaller upper fold clamping means 53 and is then secured against withdrawal or pulling out by virtue of the webs 55 returning into elastic mutual contact by means of the tooth-like projections 57 after the load on the webs 55 is relieved. Thereafter, the fabric of the curtain or drapery 62 is folded over the longitudinal sides 47, 48 of the fold clasp 2 so that respective double layers of fabric 70, 71 are located between longitudinal edges 47, 48 and the webs 40, 41. Then the fold clasp 2 is locked together with the retaining plate 1 in the manner more fully described hereinabove, whereby the two double layers of fabric 70, 71, each forming an outer fold base, are firmly secured against being withdrawn or pulled out from between the retaining plate 1 and the fold clasp 2.

The thicker and/or the heavier the fabric of the curtain or drapery 62, the higher the locking forces in the fold clamping means 52, 53 and between the clasp section 37 of the fold clasp 2 and the retaining plate 1 since the webs 54, 55 and the elastic wings 72, 73 of the clasp section 37 are elastically deformed in dependence on the thickness of the fabric.

As noted hereinabove, the hook 3 can be attached to the retaining plate at any desired level and thereafter the entire curtain or drape 62 may be securely but detachably attached by means of the hook 3 to a curtain rod so that the fold or pleat fixing arrangement is versatile and usable in the so-called American suspension system.

As shown most clearly in FIG. 1, aligned lugs 75, 76 oriented toward each other are arranged at end pieces 74 provided at the upper end of the retaining plate 1. By means of the lugs 75, 76, attachment to a rolling or sliding suspension means is possible in a manner set forth more clearly in, for example, Offenlegungsschrifts Nos. 24 53 460 and 25 42 963 and commonly assigned U.S. patent application Ser. No. 631,197, now U.S. Pat. No. 4,125,143, the disclosure of which is incorporated herein by reference to the extent necessary in understanding the present invention.

It is furthermore possible by means of the present invention to attach pre-fabricated curtains or draperies, that is, curtains or draperies firmly joined to the pleat or fold fixing device of the present invention, by hanging or suspending the device on a carrying device such as described in greater detail in, for example, Offenlegungsschrift No. 25 53 834 and commonly assigned copending U.S. patent application Ser. No. 745,984, now abandoned, the disclosure of which is incorporated herein by reference to the extent necessary in understanding the present invention. By virtue of the utilization of the afore-mentioned carrying devices, the mounting and/or removing of the curtain or drapery and/or the washing, cleaning, transportation and storage of the curtains or drapes is greatly facilitated.

The retaining plate 1, fold clasp 2 and the hook 3 are each fashioned or constructed in one piece and consist of a hard elastic thermoplastic synthetic resinous material. Preferably, the retaining plate 1, the fold clasp 2 and the hook 3 are suitably manufactured of an alkai- and light-resistant synthetic resin such as, for example, a polyamide. As can be seen from the drawings, the fold or pleat fixing device is long as compared to its width so that all fold bases can be gathered relatively densely; however, a sufficient fixation and holding length is nevertheless available.

In order to give the folds or pleats 63–66 of the curtain or drapery a satisfactory rigidity, that is, to render the folds or pleats 63–66 sufficiently dimensionally stable, as shown in FIG. 12, a reinforcing band 77 consisting of knit or woven fabric is also arranged in the fold fixing arrangement at the same time the folds or pleats 63–66 are being produced.

In order to provide a clearer illustration of the invention, the band 77 is shown in FIG. 12 as merely being provided at the lateral zones of the fold or pleat fixing device; however, the band 77 closely contacts the rear side of the fabric and also extends along the folds or pleats 63–66 on their respective inner sides. Preferably, a reinforcing band 77 will normally be of such a width that it extends from the top edge of the curtain or drapery to below the lower fold clamping means. However, particularly in the case of a curtain, the reinforcing band 77 can simply be a lining fabric attached to its back. Normally, such a reinforcing band 77 will be attached to the curtain or drapery by sewing.

While we have shown and described only one embodiment in accordance with the present invention, it is understood that the same is not limited thereto, but is susceptible of numerous changes and modifications as known to one having ordinary skill in the art, and we therefor do not wish to be limited to the details shown and described herein, but intend to cover all such modifications as are encompassed by the scope of the appended claims.

We claim:

1. An arrangement for fixing folds in curtains or drapes, the arrangement comprising:

a retaining plate member, a fold clasp member, means for detachably elastically locking said fold clasp member to said retaining plate member, said elastic locking means being provided on a backside of said fold clasp member and including locking members arranged substantially centrally of said fold clasp member and elastically deformable portions provided on respective sides of said locking members, said portions including outer longitudinal sides which extend in proximity of the retaining plate member when said fold clasp member and said retaining plate member are in a locked condition, and at least two mutually aligned folding clamping means provided on a front side of said fold clasp member for receiving at least one fold of the curtain or drape and for fixing the fold thereat.

2. The arrangement according to claim 1, wherein said fold clasp member includes a plurality of tooth-like projections arranged in rows along respective longitudinal edges thereof, and wherein said retaining plate member includes a plurality of tooth-like projections arranged in rows along respective longitudinal edges thereof, said tooth-like projections of said fold clasp member and said retaining plate member being arranged such that the individual tooth-like projections of the fold clasp member pass between adjacent tooth-like projections of the retaining plate member during a locking of the fold clasp member to the retaining plate member so as to maintain a spacing between the fold clasp member and the retaining plate member.

3. The arrangement according to claim 1, wherein each of said at least two mutually aligned fold clamping means includes a pair of spaced webs.

4. The arrangement according to claim 3, wherein said pair of spaced webs are vertically extending webs, as viewed in a normal hanging direction of the curtains or drapes, said webs defining a fold receiving slot which is open at the top and bottom thereof, and wherein each of said webs includes barb-like projections on a free end thereof with the barb-like projections of the respective pairs of webs being directed toward one another so as to maintain the fold under an elastic clamping action in the fold receiving slot.

5. The arrangement according to claim 4, wherein said fold clasp member has a cross-section which is approximately a configuration of an annular cylindrical segment.

6. The arrangement according to claim 4, wherein the fold clasp member includes an inner surface, and wherein said locking members are arranged on the inner surface of the fold clasp member, said locking members including at least one pair of elastic webs, each having outwardly extending projections with abutment surfaces, and wherein said retaining plate member includes locking openings for receiving the locking members, said locking openings being provided with contact surfaces which engage the abutment surface of said elastic webs during a locking of said fold clasp member to said retaining plate member.

7. The arrangement according to claim 4, further comprising a hook member, said hook member including at least one row of at least two projecting pegs, and wherein the retaining plate member includes openings therein for accommodating said projecting pegs, whereby said hook member may be mounted to said retaining plate member.

8. The arrangement according to claim 7, wherein said hook member includes a plate, a bracket having a first end mounted to said plate and a free end which extends in a direction outwardly and downwardly from said plate, and means provided on said plate for receiving and securing the free end of said bracket upon a bending and slight lateral deformation of said bracket.

9. The arrangement according to claim 3, wherein said fold clasp member has a cross-section which is approximately a configuration of an annular cylindrical segment.

10. The arrangement according to claim 3, wherein the fold clasp member includes an inner surface, and wherein said locking members are arranged on the inner surface of the fold clasp member, said locking members including at least one pair of elastic webs, each having outwardly extending projections with abutment surfaces, and wherein said retaining plate member includes locking openings for receiving the locking members, said locking openings being provided with contact surfaces which engage the abutment surface of said elastic webs during a locking of said fold clasp member to said retaining plate member.

11. The arrangement according to claim 3, further comprising a hook member, said hook member including at least one row of at least two projecting pegs, and wherein the retaining plate member includes openings therein for accommodating said projecting pegs, whereby said hook member may be mounted to said retaining plate member.

12. The arrangement according to claim 11, wherein said hook member includes a plate, a bracket having a first end mounted to said plate and a free end which extends in a direction outwardly and downwardly from said plate, and means provided on said plate for receiving and securing the free end of said bracket upon a bending and slight lateral deformation of said bracket.

13. The arrangement according to claim 1, wherein said elastic locking means maintains said fold clasp member at a spacing from said retaining plate member.

14. The arrangement according to claim 1, wherein said at least two mutually aligned fold clamping means on the front side of said fold clasp member are provided at a predetermined distance from each other.

15. The arrangement according to claim 2, wherein said elastically deformable portions provided on respective sides of said locking members are wing-shaped.

16. The arrangement according to claim 1, wherein at least one of said fold clamping means extends outwardly from the front side of the fold clasp member a distance corresponding to approximately a depth of the at least one fold to be fixed, and wherein the other of said fold clamping means extends outwardly from the front side of the fold clasp member by a distance which is less than the distance said one of said fold clamping means extends from the front side of said fold clasp member.

* * * * *